United States Patent [19]

Metcalf

[11] 3,995,744

[45] Dec. 7, 1976

[54] MERCHANDISE DISPLAY RACK

[75] Inventor: Derek N. G. Metcalf, La Grange Park, Ill.

[73] Assignee: Athena Industries, Inc., La Grange, Ill.

[22] Filed: Feb. 28, 1975

[21] Appl. No.: 554,311

[52] U.S. Cl. ..... 211/131; 211/181; 248/223

[51] Int. Cl.[2] ..... A47F 5/14

[58] Field of Search ..... 211/131, 177, 181, 182, 211/176, 50, 47, 58, 56; 248/223, 415, 159, 175

[56] References Cited

UNITED STATES PATENTS

| | | | |
|---|---|---|---|
| 3,267,887 | 8/1966 | Boyd | 248/223 |
| 3,921,813 | 11/1975 | Cimino | 211/131 |

*Primary Examiner*—Roy D. Frazier
*Assistant Examiner*—Robert W. Gibson, Jr.
*Attorney, Agent, or Firm*—McCaleb, Lucas & Brugman

[57] ABSTRACT

A collapsible merchandise display system employing a ground engaging pedestal having a central tubular hub for receiving an upright support pole on which are rotatably mounted one or more support means. Each support means is particularly distinguished by parallel spaced rails separated by a vertical space or gap for receiving mounting hook portions of wire formed display baskets. The baskets are uniquely constructed to define an open top article confining pocket having a generally open front wall defined by an article restraining barrier related to the upper rim of the basket in such a fashion as to permit internesting of the baskets. Since the system components are readily assembled and disassembled, the same are conveniently transported and stored in knocked down condition to minimize shipping and storage volume.

4 Claims, 5 Drawing Figures

MERCHANDISE DISPLAY RACK

This invention relates generally to display racks, and more particularly to an improved display system and rack structure for supporting and displaying articles of merchandise such as books, magazines and the like, in individual wire formed baskets. The system of this invention is further distinguished by a knock down or collapsible capability of its various components featured by the internestability of individual article holding baskets so as to minimize space requirements for transportation and storage of the system.

In the past, display rack systems of the type to which the present invention pertains, employing individual display baskets for holding books, magazines, records and like articles, in general have been constructed as rigid or semi-collapsible structures constructed and assembled at the factory and shipped in assembled condition to the merchandiser for installation. It is the general design theme of such display systems to provide a plurality of individual pockets or article receptacles whereby the customer is afforded a high range of commodity selection. With few exceptions, such display racks of the prior art have been voluminous, cumbersome and necessarily uneconomical to handle, transport and store. To alleviate this problem, there have been previous efforts to provide collapsible display rack systems, but to my knowledge, such have been unduly cumbersome and complex in their structure and have not generated widespread acceptance, principally because of the inconvenience and time consuming nature of their assembly requirements.

The present invention is directed to an improved display rack system which alleviates the foregoing noted problems, of previously known rigid or semi-collapsible systems, by providing a simplified and readily collapsible assembly employing light weight, wire formed components including a plurality of article receiving baskets, to hold and display merchandise and particularly characterized by a unique formation and structural arrangement leading to their nesting capability. Such feature when taken with the collapsible nature of the means for supporting the display baskets greatly minimizes shipping and storage volume and weight requirements.

It is an important object of this invention to provide an improved collapsible merchandise display rack system.

Another object of this invention is to provide an improved display rack system as aforesaid, employing novel wire formed baskets in which articles of merchandise are stored and displayed and which baskets are featured by simplified means for removably interconnecting the same with support means of the display system.

A further object of this invention is to provide an improved display rack assembly employing wire formed baskets for confining articles to be displayed and which are capable of being internested to minimize shipping and storage space.

A still further important object of this invention is to provide an improved display rack system which is readily erected and collapsed and which leads to improved economies of manufacture, transportation and utilization.

Having thus described the present invention, the above and further objects, features and advantages thereof will be recognized by those familiar with the art from the following detailed description of a preferred embodiment illustrated in the accompanying drawings and constituting the best mode presently contemplated to enable those skilled in the art to understand and practice this invention.

Figure 1:
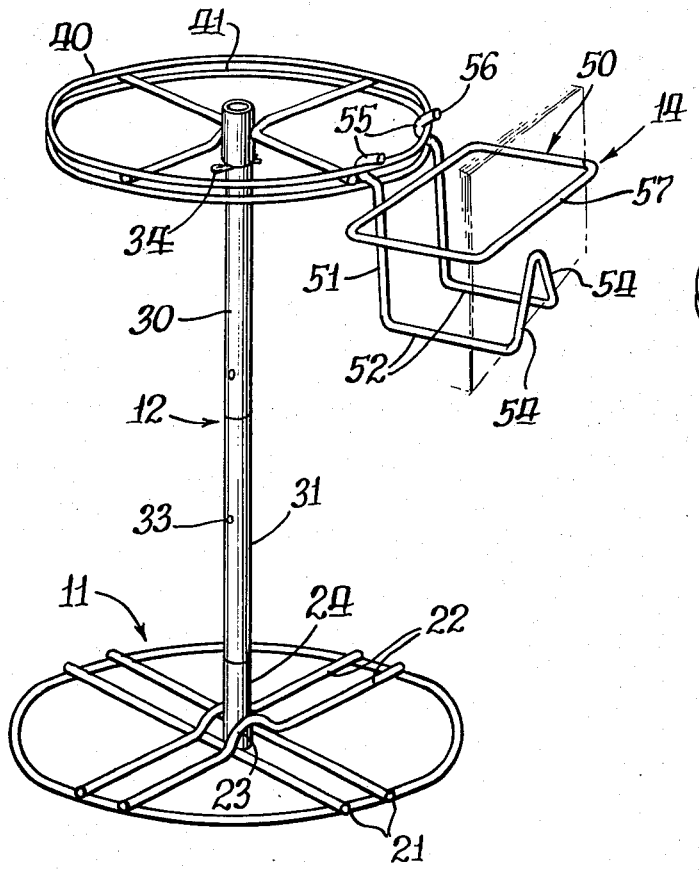
FIG. 1 is a perspective view of an assembled display rack system according to this invention.
Figure 2:
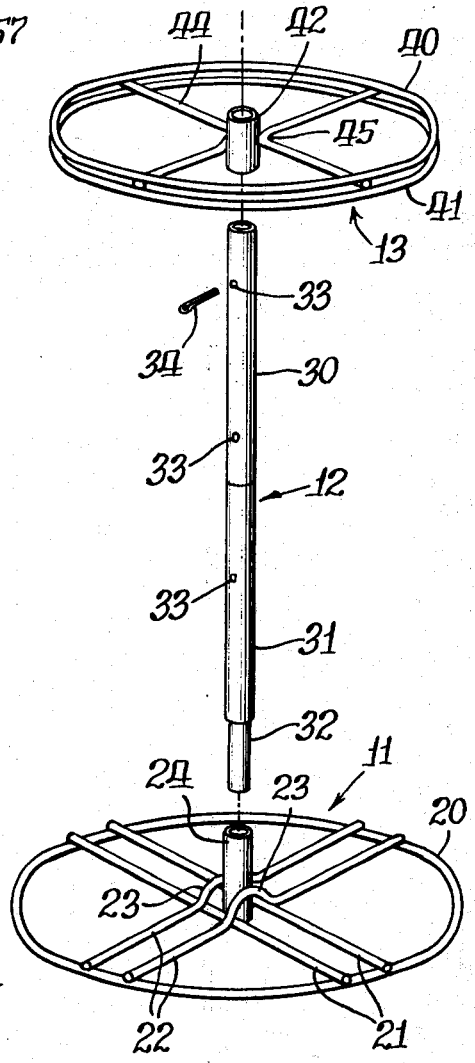
FIG. 2 is an exploded perspective view, similar to FIG. 1, illustrating collapsible features of the system components.
Figure 3:
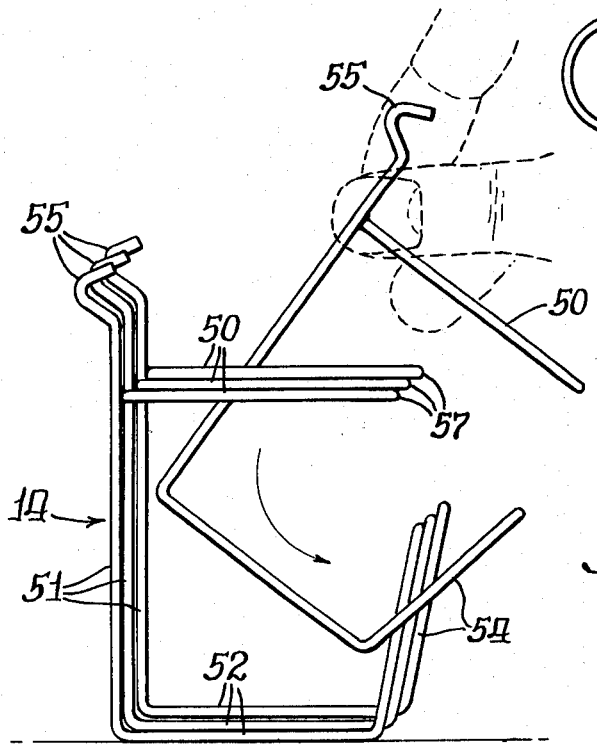
FIG. 3 is an enlarged side elevational view of several typical display baskets according to this invention and illustrating their internestability.

Turning now to the specific features of the preferred embodiment illustrated in the drawings, initial attention is directed to FIGS. 1 and 2 where the system's components are illustrated. As shown in those Figures, the improved display rack structure, indicated generally by numeral 10, comprises a support base 11, a tubular pole assembly 12 carrying a support means 13 and a plurality of individual merchandise display basket means 14 attachable to means 13.

With specific reference to individual features of the above noted components for display system 10, the support base 11 (see FIG. 2), according to the particular illustrated embodiment, comprises an annular metal rim member 20, having a first pair of parallel spaced linear support rods 21, 22 extending diametrically thereacross. A second pair of support rods 22, 22 likewise extend transversely across the rim member 20 and intersect the rods 21 near the center of the rim member. Support rods 21 and 22 are suitably formed of relatively heavy wire or metal rod material and are spot welded to the rim member and each other at their areas of intersecting engagement, to provide a rigid structure. It is particularly to be noted that the rod members 22, 22 are formed with a central semi-circular portion 23 substantially at their mid points so as to overlyingly bypass rods 21. A tubular hub member 24 is disposed in upright position centrally of the rim member and located between the intersecting pairs of rod members 22 and 21. Hub member 24 is suitably welded to the adjacent portions 23 of the rod members 22 as well as to the lower rod members 21.

It will be recognized that the base member 11 is of a diameter and size, despite its relatively light weight connstruction, to provide a stabilizing ground engaging support pedestal or base for the tubular pole 12.

Figures 4, 5:
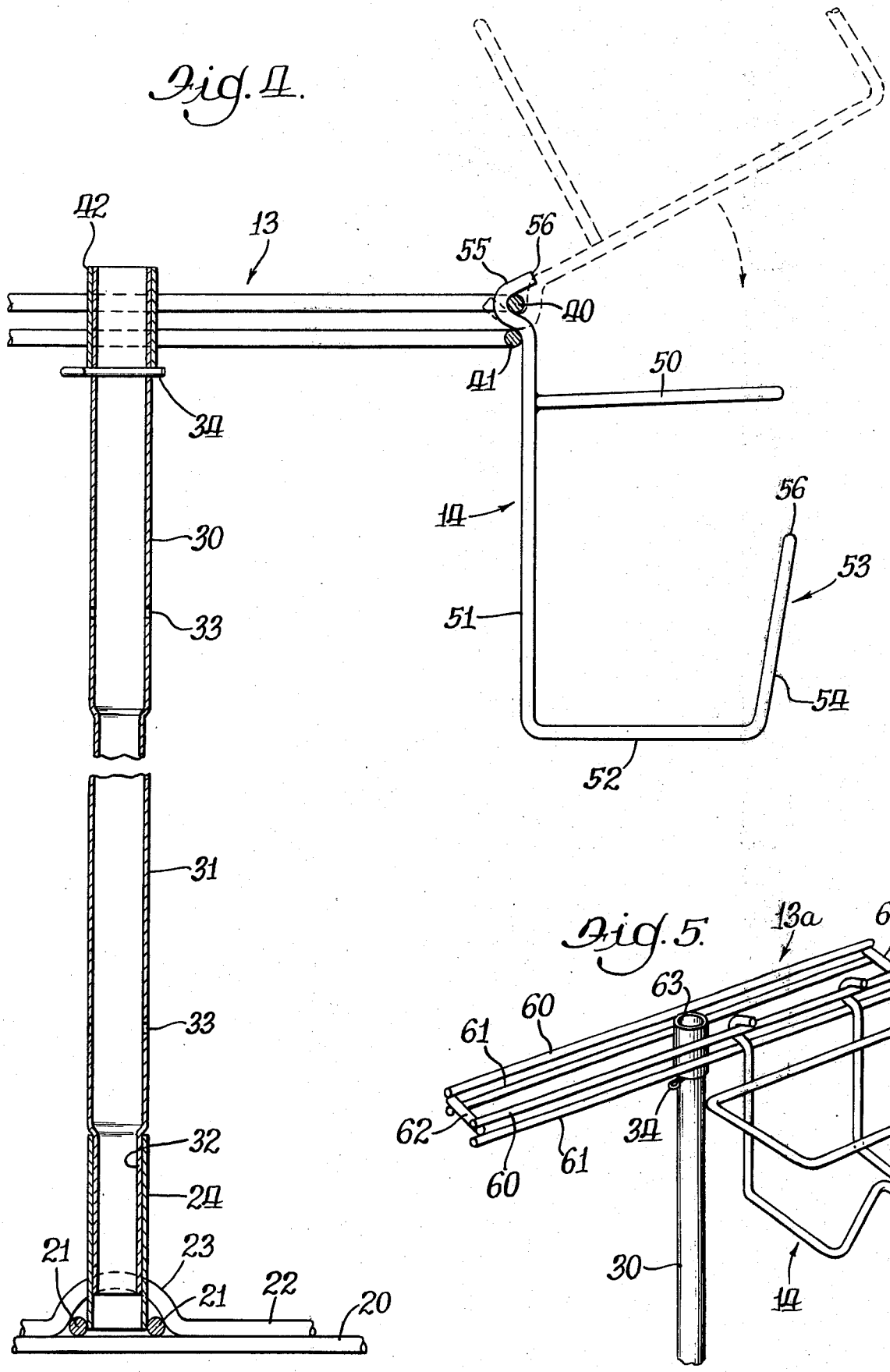
FIG. 4 is an enlarged view in side elevation, with portions thereof foreshortened and in section, of the display system illustrated in FIG. 1 depicting the mode of interconnecting the display baskets with the support means.
FIG. 5 is a partial perspective view of an alternate support means according to this invention.

As shown in FIGS. 1, 2 and 4 of the drawings, the pole 12 comprises one or more sections of metal tubing, such as sections 30 and 31 illustrated in FIGS. 1 and 2, which are identically formed in desirable sectional lengths and each with a necked-down or reduced diameter portion 32 at one end (see FIG. 4). Thus adjacent tubular sections of the pole may be coaxially interfitted to achieve the desired height for the display stand. It also will be noted that the lowermost tube section 31, as illustrated in FIGS. 1 and 2, is supported on the pedestal base 11 by inserting its necked down

UNITED STATES PATENT OFFICE

CERTIFICATE OF CORRECTION

PATENT NO. : 3,995,744
DATED : Dec. 7, 1976
INVENTOR(S) : DEREK N. G. METCALF

It is certified that error appears in the above-identified patent and that said Letters Patent are hereby corrected as shown below:

In the heading [56], line 5, add the following:

| | | | |
|---|---|---|---|
| 832,638 | 10/1906 | Thorpe | 211/181 |
| 983,392 | 2/1911 | Nielsen | 248/159 |
| 2,221,659 | 11/1940 | Wilkie | 211/50 |
| 2,595,837 | 5/1952 | Freeman | 211/58 |
| 2,738,075 | 3/1956 | Guignard et al | 211/181 |
| 2,941,669 | 6/1960 | Palay et al | 248/223 |
| 3,141,557 | 7/1964 | Marschak | 211/177 |

FOREIGN PATENTS OR APPLICATIONS

| | | | |
|---|---|---|---|
| 785,557 | 5/1968 | Canada | 211/58 |

Column 2, Line 37: "22" should be --21--
Column 2, Line 56: "connstruction" should be --construction--
Column 5, Line 1: "for" should be --of--

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*